US005187921A

United States Patent [19]

Wilson et al.

[11] Patent Number: 5,187,921

[45] Date of Patent: Feb. 23, 1993

[54] METHOD AND APPARATUS FOR FILLING CAVITIES

[75] Inventors: Alan A. Wilson, Bishops Stortford; Peter J. Brand, Royston; David R. Judd, Buntingford; Stanley G. Bonney, Nr. Ware, all of United Kingdom

[73] Assignee: Glaxo Group Limited, Middlesex, England

[21] Appl. No.: 753,895

[22] Filed: Sep. 3, 1991

[30] Foreign Application Priority Data

Sep. 4, 1990 [GB] United Kingdom ..... 9019270.9
Jul. 15, 1991 [GB] United Kingdom ..... 9115210.8

[51] Int. Cl.[5] ..... B65B 1/06; B65B 1/10; B65B 1/36; B65B 1/46

[52] U.S. Cl. ..... 53/453; 53/467; 53/473; 53/559; 53/502; 53/242; 141/1; 141/83; 141/11

[58] Field of Search ..... 53/453, 454, 471, 473, 53/53, 502, 51, 55, 64, 559, 560, 289, 242; 141/1, 83, 108, 111, 124, 164

[56] References Cited

U.S. PATENT DOCUMENTS

| | | | |
|---|---|---|---|
| 1,595,195 | 8/1926 | Ingram | 53/502 X |
| 2,555,369 | 6/1951 | Pollitt et al. | 53/560 X |
| 3,315,438 | 4/1967 | Kostur | 53/141 |
| 3,464,182 | 9/1969 | Nichols | 53/184 |
| 3,475,878 | 11/1969 | West, Jr. | 53/559 X |
| 3,733,773 | 5/1973 | Hamilton | 53/184 |
| 3,767,349 | 10/1973 | Jezuit | 425/387 |
| 3,808,772 | 5/1974 | Turtschan | 53/141 |
| 4,012,888 | 3/1977 | Nichols | 53/131 |
| 4,065,911 | 1/1978 | Fagan | 53/502 X |
| 4,094,127 | 6/1978 | Romagnoli | 53/51 |
| 4,287,702 | 9/1981 | Corbic | 53/559 X |
| 4,472,922 | 9/1984 | Romagnoli | 53/53 |
| 4,490,963 | 1/1985 | Knudsen | 53/559 |
| 4,506,495 | 3/1985 | Romagnoli | 53/559 |
| 4,630,426 | 12/1986 | Gentry | 53/559 X |
| 4,662,149 | 5/1987 | Hamilton | 53/453 |
| 4,726,173 | 2/1988 | Giatti | 53/559 |
| 4,875,329 | 10/1989 | Miselli | 53/559 |
| 4,905,450 | 3/1990 | Hansen | 53/453 X |
| 4,918,907 | 4/1990 | Roach et al. | 53/453 |
| 4,987,728 | 1/1991 | Ventura | 53/559 |
| 5,014,489 | 5/1991 | Terminella et al. | 53/51 |

FOREIGN PATENT DOCUMENTS

| | | |
|---|---|---|
| 0257990 | 2/1987 | European Pat. Off. . |
| 0359242 | of 1989 | European Pat. Off. . |
| 0415415 | of 1990 | European Pat. Off. . |
| 2409766 | 1/1974 | Fed. Rep. of Germany . |
| 3325674 | of 1983 | Fed. Rep. of Germany . |
| 3612190 | 11/1986 | Fed. Rep. of Germany . |
| 677069 | 3/1949 | United Kingdom . |
| 683135 | 10/1950 | United Kingdom . |
| 1072086 | 8/1965 | United Kingdom . |
| 1303948 | 5/1971 | United Kingdom . |
| 1429001 | 3/1973 | United Kingdom . |
| 2184086 | 6/1987 | United Kingdom . |
| 2195326 | 4/1988 | United Kingdom . |

*Primary Examiner*—Horace M. Culver
*Attorney, Agent, or Firm*—Darby & Darby

[57] ABSTRACT

A method and apparatus are described for filling a blind cavity, for example a blister of a blister pack, with a quantity of powder. The cavity, with its open side downwards, is urged into a reservoir (30) of powder, and withdrawn from the reservoir with the quantity of powder therein. An elongate sheet (12) with a plurality of blisters disposed along the length thereof preferably passes around, and travels with, a wheel (38) partially immersed in the reservoir (30) of powder.

36 Claims, 10 Drawing Sheets

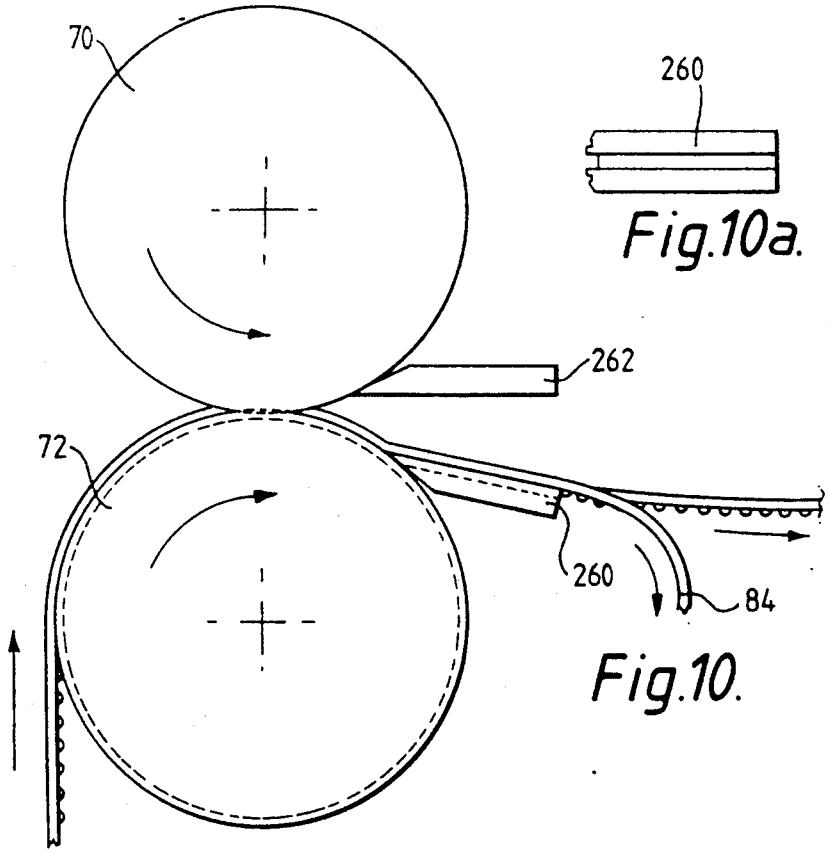
Fig.10a.
Fig.10.
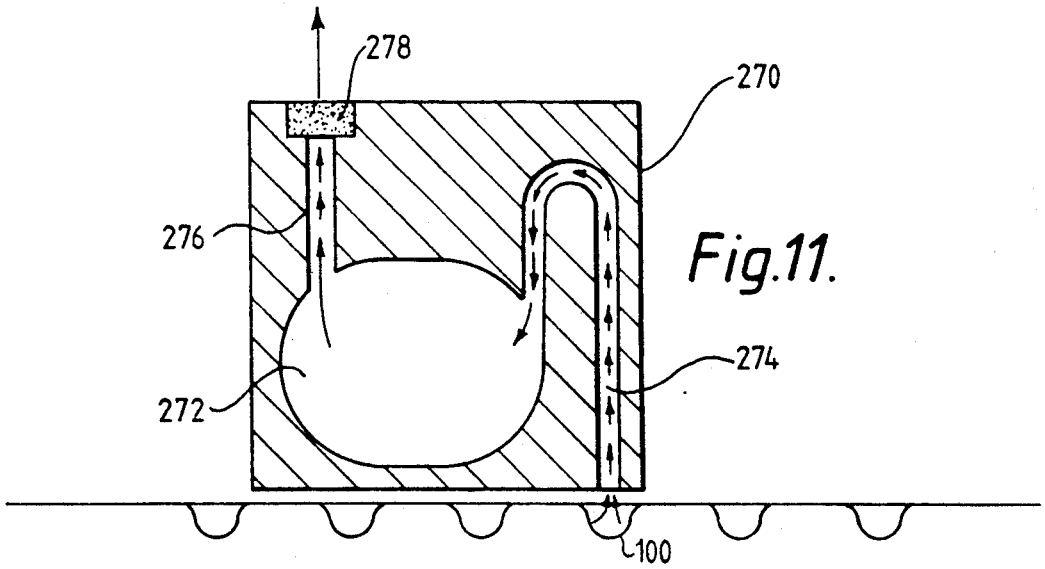
Fig.11.

METHOD AND APPARATUS FOR FILLING CAVITIES

This invention relates to a method and apparatus for filling blind cavities with powder. The invention has particular application to the situation where the blind cavities are defined by the blisters of blister packs, but is applicable to cavities defined in other ways. The invention further relates to a method and apparatus for forming, filling and sealing such cavities.

Blister packs are used, inter alia, to hold doses of medicament in powder form, for example medicament which is to be inhaled by a patient, and the following description concentrates on that use. However, it must be understood that the invention is also applicable to blister packs which are to contain other forms of powder.

According to the invention there is provided a method of filling a blind cavity with a quantity of powder, which comprises urging the cavity, with its open side downwards, into a reservoir of powder, and withdrawing the cavity therefrom with the quantity of powder therein.

The invention further provides an apparatus for filling a blind cavity with a quantity of powder, which comprises a reservoir for containing powder, and means for urging the cavity, with its open side downwards, into the reservoir of powder and for withdrawing the cavity therefrom with the quantity of powder therein.

The invention also provides a method of forming, filling and sealing a blind cavity, which comprises means for forming a cavity in a substrate, means as defined above for filling the cavity with a quantity of powder, and means for securing a lid to the substrate so that the powder is enclosed in a container defined by the substrate and lid.

The invention further provides an apparatus for forming a pack, which comprises means for forming a cavity in a substrate, means as defined above for filling the cavity with a quantity of powder, and means for securing a lid to the substrate to enclose the powder within a container defined by the substrate and lid.

Preferably, the cavities referred to above are defined by the blisters of blister packs.

The invention will now be described with reference to the accompanying drawings, in which:

FIG. 1 is an elevation of a first embodiment of an apparatus according to the present invention;

FIGS. 2*a* and 2*b* are a plan view and front elevation, respectively, on a larger scale, showing the portion of the apparatus of FIG. 1 where the blisters are filled;

FIG. 3*a* shows, on a still more enlarged scale, part of the roller assembly used in the portion of the apparatus of FIG. 1 where the blister pack is cut to width;

FIG. 3*b* is a section on line A—A in FIG. 3*a;*

FIG. 10 shows, again on a larger scale modifications to the slitting rollers, with FIG. 10*a* being a plan view of one of the separators indicated in FIG. 10; and FIG. 11 shows an arrangement for measuring the weight of powder in a blister.

Figure 1:
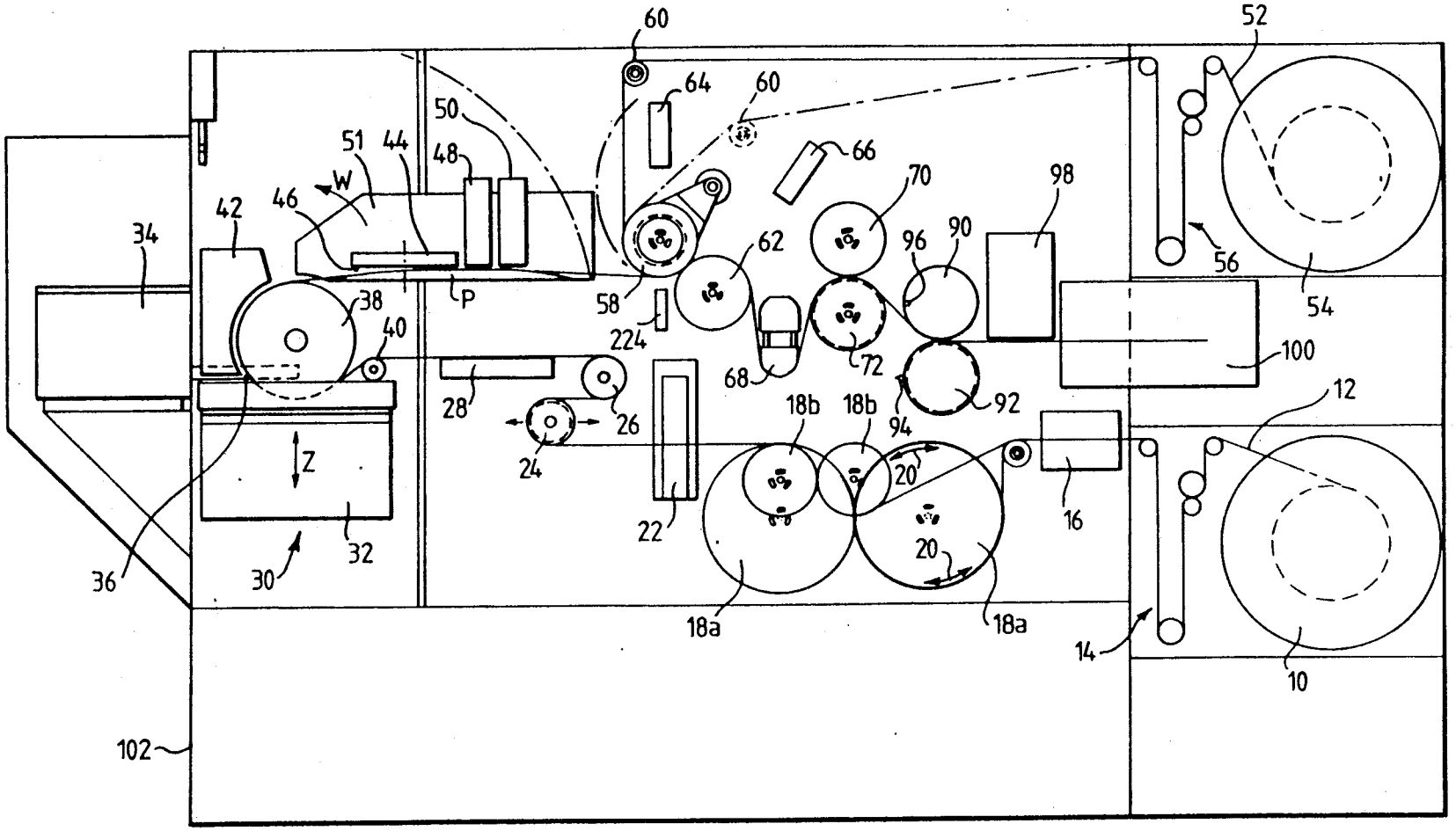

Referring first to FIG. 1, this shows a reel 10 from which is unwound a base sheet 12 in which are to be formed the blisters of a blister pack. The base sheet 12 passes through an assembly of rollers 14 which are mounted to control the tension in the base sheet in known manner. The sheet then passes through a cleaning station 16 where it is cleaned. From there the sheet passes between a pair of rollers 18, in one of which an array of protrusions is spaced around the circumference thereof, and in the other of which there is a series of mating depressions. The drawing shows two pairs of rollers, namely a larger pair 18*a* and a smaller pair 18*b*. Only one of these pairs of rollers would be present at any given time, and both are illustrated simply to show how this portion of the machine might be adapted for differing circumstances.

The apparatus shown in FIG. 1 is intended to produce blister packs in the form of elongate strips, each having a plurality of blisters (say sixty such blisters) along its length. Considering the pair of rollers 18*a*, one of these has two sets of, say, sixty depressions separated by land sections with no such depressions, and the other has two sets of protrusions separated by land sections with no such protrusions. In the case of one of the rollers 18*a*, the land sections are denoted by reference numeral 20. Similar land sections are present on the other roller 18*a*, and on both the rollers 18*b* (though there is only one land on each roller 18*b*), but have not been so denoted, to avoid making the drawing unnecessarily complex at this point. During one complete revolution of the rollers 18*a* blisters are formed in a length of base sheet which will ultimately form the base of two blister packs. During one complete revolution of each of the rollers 18*b* blisters are formed in a length of base sheet which will ultimately form the base sheet of one blister pack.

From the rollers 18 the base sheet with the blisters formed therein passes through a split detection device 22 which detects the presence of any splits which may have been produced in the base sheet by the rollers 18 or otherwise, and sends a signal to a sample/reject device (see below) to indicate the presence of any such split. The split detector 22 may conveniently be a photoelectric device, though it could alternatively work on some other basis.

From the detector 22 the base sheet passes through an automatic tensioning system comprising a pair of rollers 24 and 26, the roller 24 being movable as indicated by the arrows. After the roller 26 the base sheet passes across a static eliminator 28 which serves to remove any static charge which may have accumulated on the sheet. It is to be understood that as the base sheet passes around the rollers 24 and 26 and over the static eliminator 28, the blisters face outwards over the roller 26 and static eliminator 28, and a blister-receiving groove or set of pockets is provided in the outer surface of the roller 24, so that the blisters are not damaged. If desired, an alternative form of static eliminator can be used which the base sheet can pass through, rather than over, to eliminate static from both sides of the sheet.

The roller 24 is shown as being longitudinally adjustable, and the primary purpose of this adjustability is to overcome a potential problem arising because of the distance between the location where the blisters are formed and the location where the lid and base sheets are sealed together. There is a risk that as the base sheet passes through the apparatus it may stretch to a variable extent, and this will cause the blisters not to register with the depressions in the roller 62. Moving the roller 24 alters the path length of the base sheet through the apparatus, and hence enables registration to be achieved. FIG. 1 shows a sensor 224 located adjacent the roller 58 for sensing the positions of the blisters and providing a signal to the roller 24 to enable its position to be adjusted. If no sensor 224 is provided then the roller 24 can be adjusted manually by an operator.

After the rollers 24, 26 the base sheet then passes to a filling station 30. The station 30 is shown in more detail in FIGS. 2*a* and 2*b*. The filling station 30 comprises a bowl 32 which is rotatable about a vertical axis as indicated by the arrow X in FIG. 2*a*. The bowl contains a reservoir of powder which is to be introduced into the blisters formed in the base sheet 12. For example, the powder may comprise medicament in powder form mixed with a carrier, also in powder form. Additional powder is introduced into the bowl 32 from a hopper 34 via a chute 36. The powder in the bowl 32 is agitated by a static mixer (not shown) which dips into the powder, and the surface of the powder is given a constant, flat surface by a static doctor blade (also not shown).

A filling wheel 38 is mounted for rotation about a horizontal axis and the lower portion thereof dips into the powder contained in the bowl 32. Rotation of the wheel 38 is indicated by arrow Y in FIG. 2*b*. The extent to which the wheel 38 dips into the powder, and hence the gap between the bottom of the wheel 38 and the bottom of the bowl, can be varied by upward or downward adjustment of the position of the bowl, as indicated by arrow Z in FIG. 1, in order to vary the fill weight. Typically, the bed of powder is about 15 mm deep and the gap between the bottom of the wheel 38 and the bottom of the bowl is about 10 mm.

The base sheet passes over a guide roller 40 and thence around the filling wheel 38. The blisters in the base sheet are radially inward with respect to the wheel 38, and to prevent their being crushed the wheel is provided with an annular groove 39 (see FIG. 2*a*). Alternatively, the wheel may be provided around its circumference with depressions of a size and pitch which are matched to the size and pitch of the blisters, each blister being received in a corresponding depression. As it passes around the lower portion of the filling wheel 38, the base sheet passes through the powder in the bowl 32. The blisters are open towards the powder and powder therefore enters the blisters. It has surprisingly been found that each blister receives and retains substantially the same quantity of powder, so that the wheel acts, in effect, to introduce a predetermined dose of powder into each blister. This is of particular significance in applications involving medicaments, where it is important that substantially the same quantity of medicament should be present in each blister.

Figure 2A:
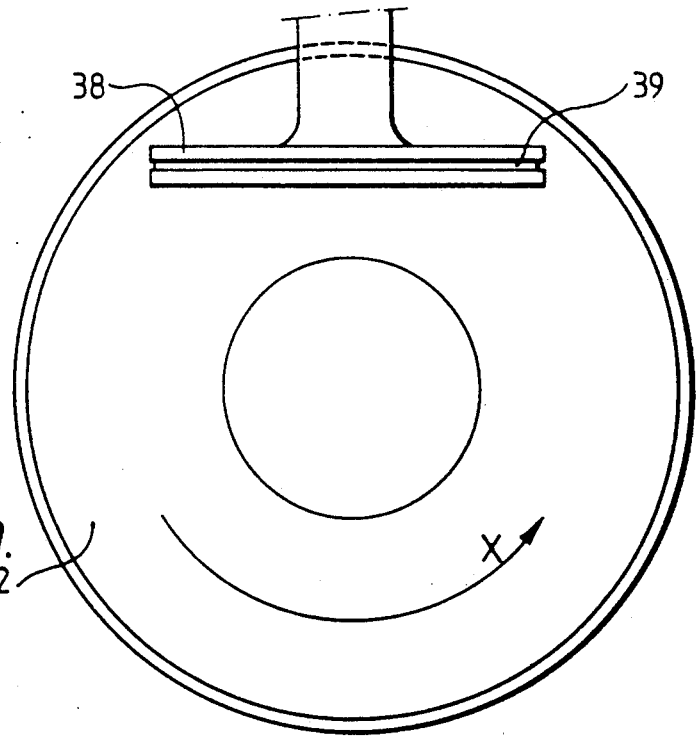
Figure 2B:
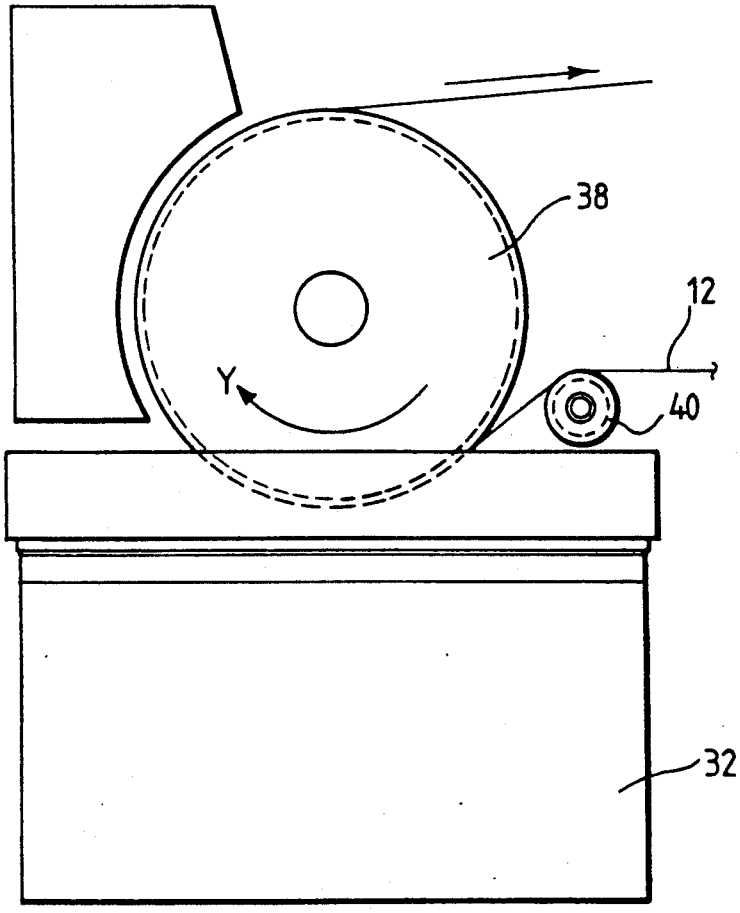

As can be seen from FIG. 2*a*, the filling wheel 38 is arranged at a location which is offset from the axis of vertical rotation of the bowl 32. The direction and speed of rotation of the bowl 32 are chosen to be such that the powder in the bowl is moving in the same general direction as the portion of the base sheet immersed in the powder, and at substantially the same speed. It will be obvious that, for reasons of geometry, precise matching of the two cannot be achieved, since, as viewed in plan, movement of the powder is arcuate and movement of the blisters is rectilinear. However, as near a match as possible is achieved. The aim of this is to reduce possible disruption to the powder in the blisters.

Figure 5:
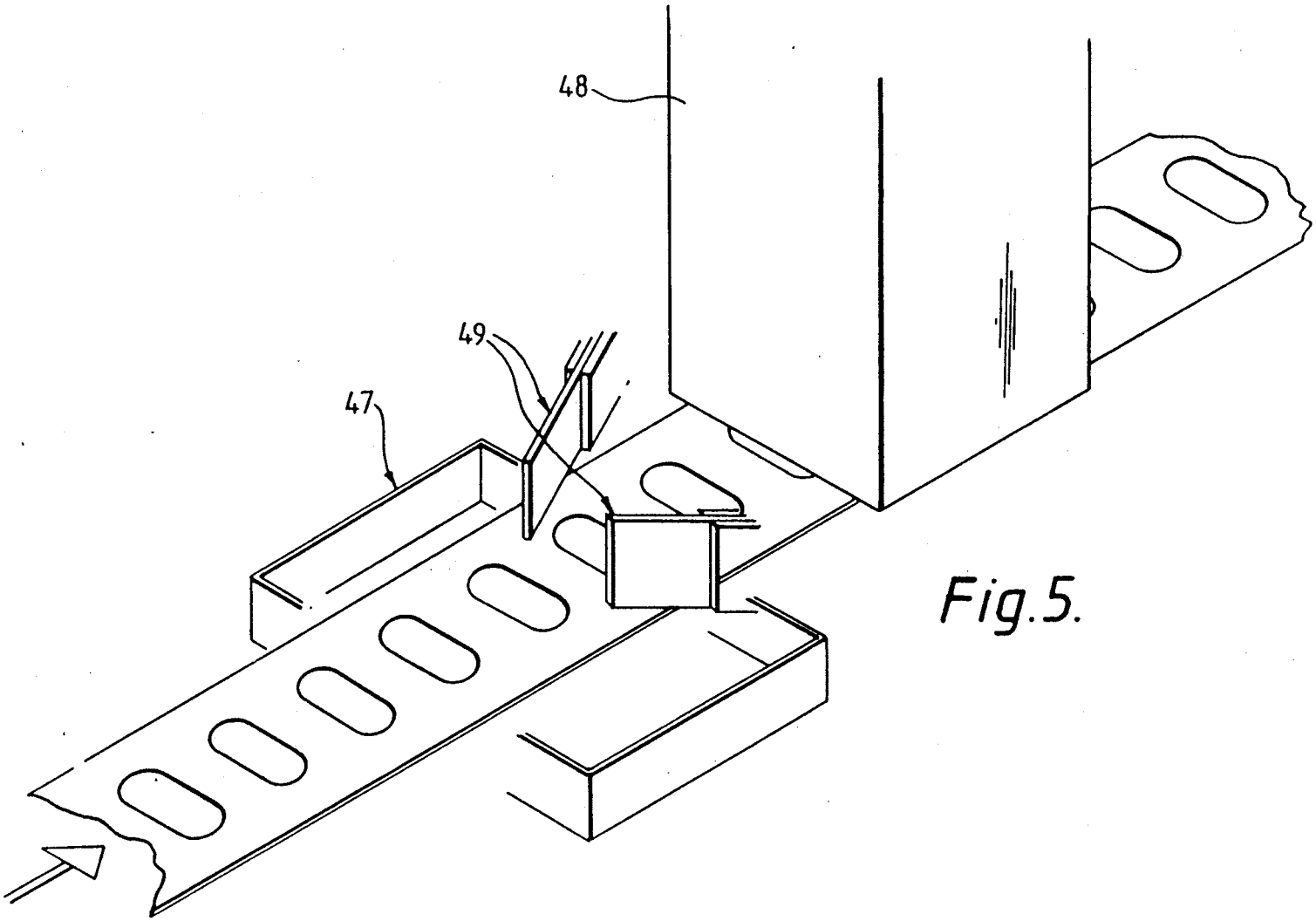
FIG. 5 is an isometric view showing, on a larger scale, part of the cleaning system used in the apparatus of FIG. 1.

The base sheet 12, with its blisters now containing powder, passes through a first cleaning station 42 where a doctor blade, for example of stainless steel or silicone rubber, wipes most of the surplus material from that surface of the base sheet on which the blisters are open. The base sheet then passes to a further cleaning device which takes the form of a wheel 44 mounted for rotation about a vertical axis. The wheel carries, on its underside, a circular array of silicone rubber teeth 46, the radial width of each tooth being substantially equal to the undeformed gap between adjacent blisters in the base sheet. Rotation of the wheel 44 is synchronised with movement of the base sheet 12 so that successive teeth wipe successive ones of the gaps between the blisters as the base sheet passes a location indicated by P in FIG. 1. The blisters occupy an area down the middle of the base sheet, and with the gaps between the blisters now cleaned by the wheel 44 the lateral portions of the base sheet, i.e. the portions on either side of the row of blisters are then cleaned by a pair of silicone rubber doctor blades 49, which have not been shown in FIG. 1 but which are shown in detail in FIG. 5. Powder wiped from the base sheet by the blades 46 is deposited in a powder collecting tray 47. Although not shown, a similar pair of doctor blades may be provided between the cleaning station 42 and the wheel 44.

After the blades 49, the base sheet passes to an inspection station 48, where the upper surface of the sheet is inspected, for example optically, to ensure that it is sufficiently free of powder. If it is found not to be, an appropriate signal is sent to a reject device at the end of the line (described further below).

The base sheet then passes a fill detection station 50 where the pockets are inspected to determine whether or not they contain powder. If any pocket is found not to contain powder an appropriate signal is sent to the above mentioned reject device.

The components 44 to 50 are mounted on a frame 51 which is itself pivotally mounted to the rest of the apparatus as indicated by arrow W. This makes it possible to vary the length over which the base sheet is in contact with a lid sheet referred to below. Alternatively, the frame 51 could be mounted for linear vertical movement, or the components 44 to 50 could be directly mounted on a fixed part of the machine.

The base sheet is now ready to be provided with a lid. The lid sheet 52 is unwound from a reel 54 and passes through a tension controlling device 56, similar in character to the device 14, which controls the tension in the base sheet. The lid sheet is made of a material which can be heat-sealed to the base sheet, and it passes to a pivotally mounted heated roller 58 via a guide roller 60. The guide roller 60 is pivotal, or otherwise movable, between the position shown in full lines and the position shown in broken lines. Moving the roller 60 alters the length over which the lid sheet is in contact with roller 58, and hence the time for which it is heated.

When sealing is to commence, the roller 58 is pivoted into contact with a pressure roller 62 so that the lid sheet 52 is brought into sealing contact with the base sheet 12 in the nip between the rollers 58 and 62. Heating of the roller 58 is controlled by two temperature sensors 64 and 66, the first of which detects the temperature of the roller 58 and the second of which detects the temperature of the surface of the sealed strip. The roller 62 is provided with depressions which receive the blisters so that these are not crushed in the nip between the rollers 58 and 62. Sealing takes place only in the area between the blisters and on either side of the blisters.

Depending on how the eventual blister packs are to be used it may be desirable for the base and lid sheets to remain unsealed over part of the sections between adjacent sets of blisters. If that is so this can be achieved by providing at least one of the rollers 58 and 68 with a recessed portion in its surface which will not contact the other of the rollers.

Figure 3A:
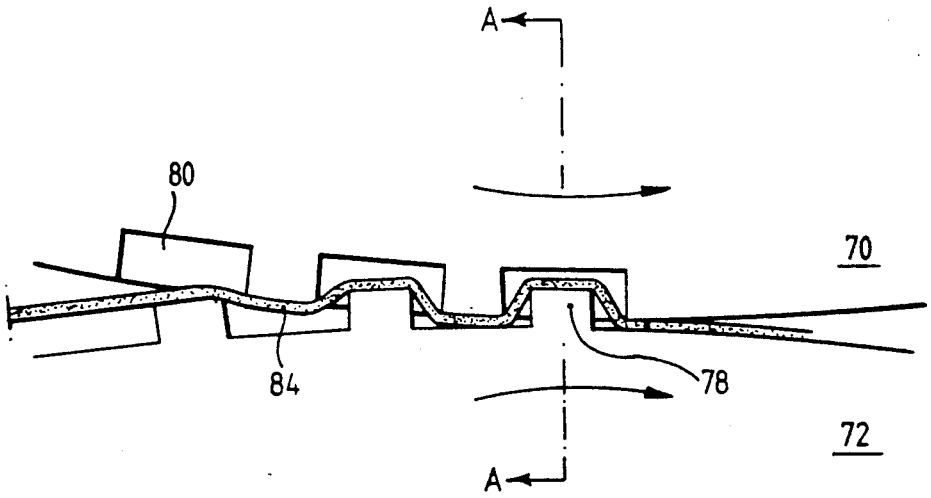
Figure 3B:
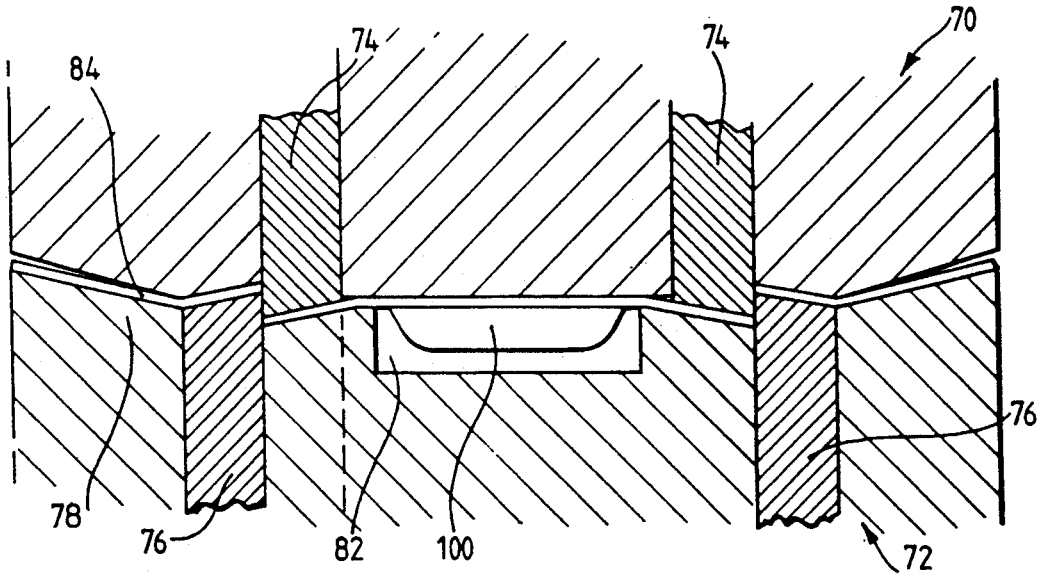

From the roller 62 the sealed assembly of base and lid sheets passes via a tensioning device 68 to a pair of slitting rollers 70 and 72 where surplus material on either side of the line of blisters is out off, leaving enough material to provide a good seal. These rollers are shown in detail in FIGS. 3*a* and 3*b*. Cutting is effected by a pair of upper slitting blades 74 on the wheel 70 and a pair of lower slitting blades 76 on the wheel 72. To keep the sealed assembly in its correct lateral position with respect to the slitting rollers, the edge portions of the assembly are gripped between crimping teeth 78 formed on the wheel 72 and cooperating crimping cavities 80 formed in the wheel 70. This forms crimped portions 84, which are then cut off by the blades 74, 76. To avoid compressing the blisters 100, the wheel 72 is provided with an annular groove 82.

The trimmed assembly then passes between a pair of rollers 90 and 92 where a knife 94 on the roller 92 cooperates with a cavity 96 in the roller 90 to sever the assembly into individual blister packs each containing the desired predetermined number of blisters. The roller 92 is provided with depressions to receive the blisters to prevent them being crushed. Under some circumstances it might be desired for the output of the apparatus to be a continuous strip, in which case the rollers 90 and 92 could be disengaged. Indeed, if it was intended always to produce a continuous strip they could be omitted altogether.

The pack then passes through a printing station 98, where any desired markings are printed on it, and thence passes to a sample/reject device 100. This receives signals from the split detector 22, the inspection station 48 and the fill detector 50, and when a pack reaches it in respect of which it has previously received a signal from any of the devices just mentioned indicating a fault, that pack is rejected.

It is to be noted that the whole of the apparatus described is completely enclosed within an enclosure 102, so that there is no scope for medicament to reach the surroundings and cause a hazard to operators.

It will be appreciated that successful operation of the apparatus described depends on precise synchronization of a number of components. This can most simply be achieved in a mechanical fashion by having a single drive motor which provides power to all the relevant components, with all those components having gear wheels or toothed belts permanently meshing with one another. However, the same result could alternatively be achieved by interconnecting the components electronically.

Figure 7:
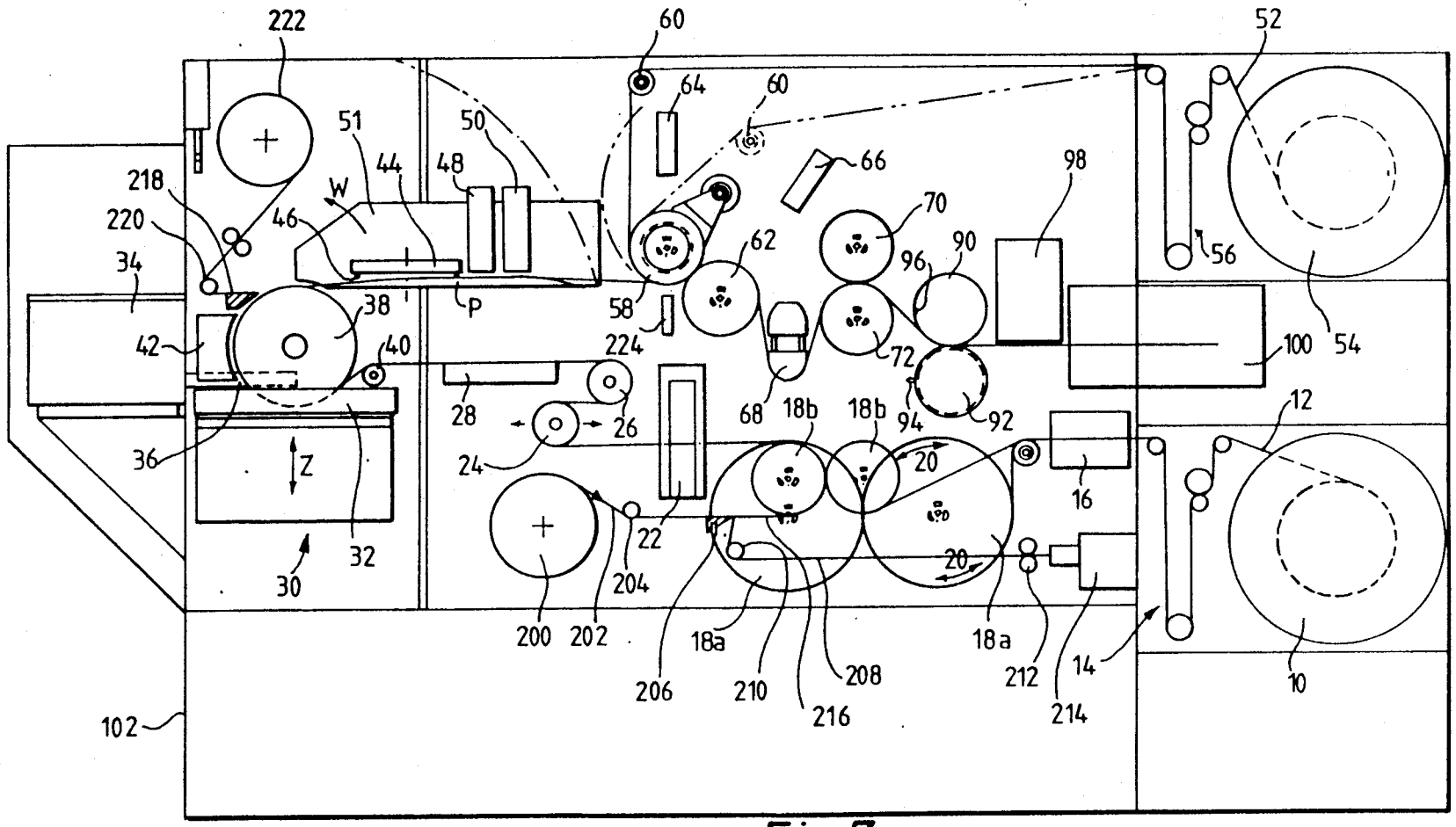
FIG. 7 is a diagrammatic elevation of a second embodiment of an apparatus according to the invention.

The embodiment of FIG. 7 is, in many respects, identical to that of FIG. 1. The following description will deal only with aspects in which FIG. 7 differs from FIG. 1.

One of the points mentioned in relation to FIG. 1 is the need to ensure that the surface of the base sheet 12 in which blisters are formed and filled with powder, is free of powder after filling in the areas where the base sheet is to be sealed to the lid sheet 52. Failure to provide a clean surface is likely to lead to defective sealing. One of the features of the apparatus shown in FIG. 7 is the provision of means for substantially avoiding any risk that powder will be deposited on the base sheet during filling, other than in the blisters formed to receive the powder. To this end the apparatus comprises a reel 200 from which is unwound a barrier film 202. The film is preferably made of a plastics material, for example, polyvinyl chloride, and a suitable film is 50 microns thick. One surface of the plastics film has a backing paper strip held thereto by adhesive. The adhesive may not always be required and may then be omitted. The barrier film is provided along its length with a series of apertures whose pitch is equal to the pitch of the blisters formed in the base sheet 12 and whose shape and size are the same as that of the blisters or slightly larger.

The barrier film 202 is unwound from the reel 200 over a roller 204 and thence passes to a beak 206 where the backing paper is stripped off the plastics film. The backing paper, denoted by reference numeral 208, passes over a roller 210 and thence through the nip of a pair of drive rollers 212 driven by a constant torque motor to a vacuum conveying unit 214 which conveys the backing paper 208 away for disposal. Alternatively, the unit 214 could be omitted and the backing paper re-reeled by a re-reeling unit. The drive rollers 212, by engaging and driving the backing paper 208, serve to pull the barrier film 202 off the reel 200, which is not itself driven but which has a drag device to keep the film 202 under constant tension. The plastics component 216 of the barrier film 202 passes round the left hand one of the rollers 18*b*, where it is brought into contact with the base sheet 12. The feeding of the plastics film 216 is controlled s that each of the apertures therein is in registry with a corresponding blister in the base sheet 12. The combination of sheets 12 and film 216 then travels to the filling station 30, where the blisters are filled with powder. Here, however, the presence of the film 216 prevents powder coming into contact with the base sheet 12 except where the blisters are located, and thus keeps the remainder of the base sheet 12 clean.

After the blisters have been filled with powder the film 216 is stripped off the base sheet 12 by passing round a beak 218 and thence, via a roller 220, to a take-up reel 222 which is driven by a slipping drive motor.

It will be seen that if the blisters are filled to the maximum possible extent at the filling station 30 then when the film 216 is stripped off a layer of powder equal to the thickness of the film will remain proud of the upper surface of the base sheet 12. This could cause problems in the subsequent sealing of the lid sheet 52 on the base sheet 12. This problem can be overcome in a number of ways, for example by not fully compacting the powder into the blisters at the filling station or by making a dip in the powder in each blister after filling using a flexible scrapper blade provided with projections.

In view of the fact that the surface of the base sheet 12 is kept clean by the use of the barrier film it is not generally necessary to provide any means for cleaning the surface after filling, and the cleaning wheel 44 with its rubber teeth 46 can normally be omitted. The re-reeling of the film 216 on the reel 222 provides containment of excess powder remaining on the film.

Figure 8:
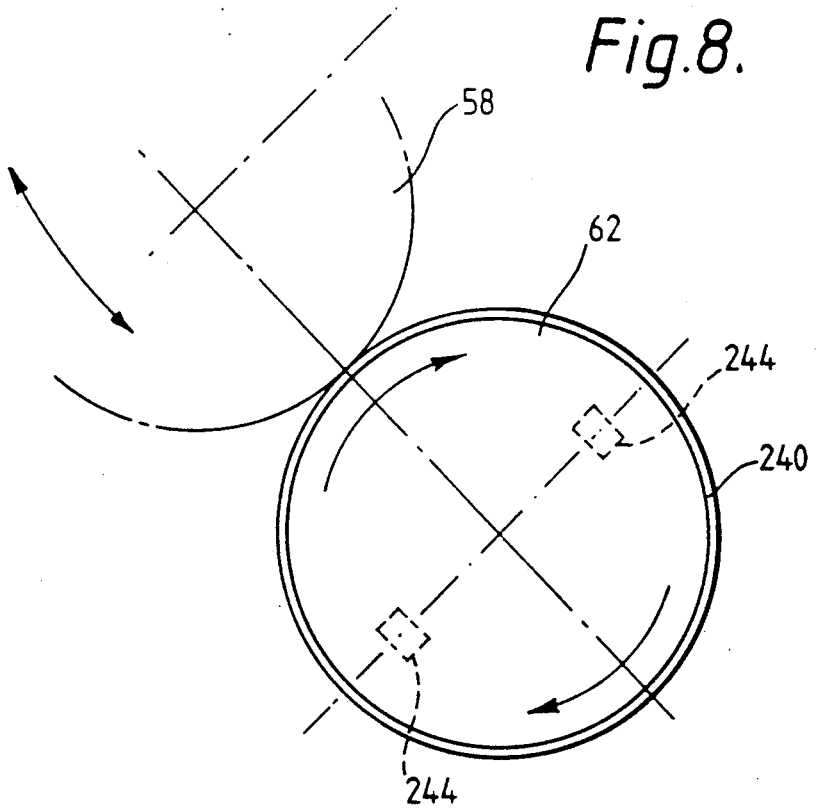
FIG. 8 shows, on a larger scale, a pair of rollers used in sealing.
Figure 8A:
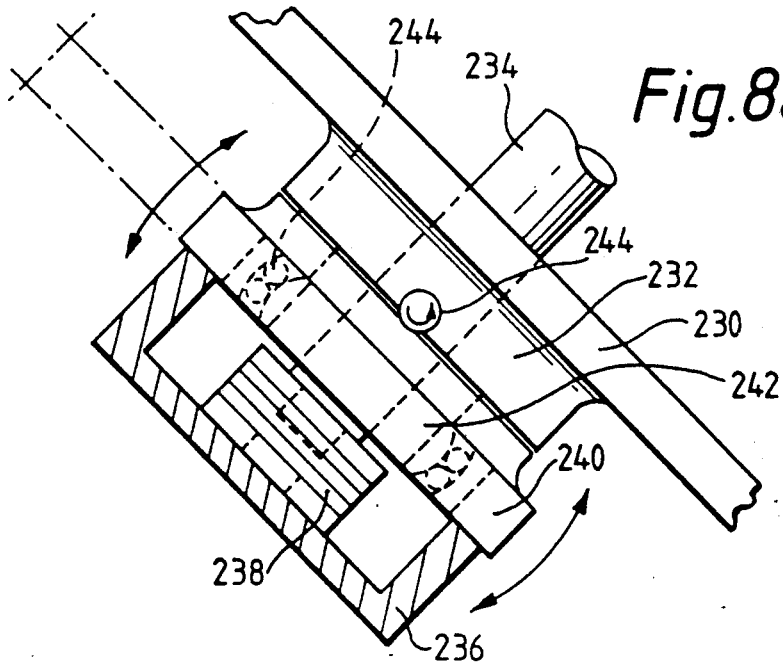
FIG. 8*a* shows the rollers of FIG. 8 in a view at right angles to FIG. 8 and partly cut away.

Turning now to FIGS. 8 and 8*a*, these show a preferred form for the rollers 58 and 62 between which the lid sheet 52 is sealed to the base sheet 12. For convenience of access these rollers are mounted in cantilever fashion, but this has the effect that as wear takes place the mating surfaces of the rollers are no longer parallel to one another. This in turn causes the seal between the lid and base sheets to be uneven, being more pronounced along one lateral edge than along the other.

The design of rollers shown in FIGS. 8 and 8*a* is intended to overcome this problem. What is shown is a bearing which is self-aligning and which uses a flexible coupling. A fixed front plate 230 of the machine is provided with a mounting boss 232, and a drive shaft 234 passes through openings in the plate 230 and boss 232 and is connected at its distal end to a drive boss 236 via a flexible coupling 238. The drive boss 236 has a cylindrical portion whose upper edge is connected to an annular ring 240 which provides the drive surface of the roller 62.

The ring 240 is rotatable mounted on a cylindrical extension 242 of the boss 232 via a self-aligning ball bearing 244. This permits the ring 240 not only to rotate as indicated by the arrows in FIG. 8, but also to pivot through a small angle in the direction indicated by the arrows in FIG. 8*a*. When the rollers 58 and 62 are in engagement with one another the force between them tends to cause the ring 240 to move as indicated by the arrows in FIG. 8*a* in such a way as to cause the mating surfaces of the rollers 58 and 62 to become substantially parallel. Two rollers 244 are mounted on the boss 232 and bear on the back of the ring 240, to prevent the ring 240 pivoting about an axis connecting the centres of the rollers 58 and 62.

Figure 9:
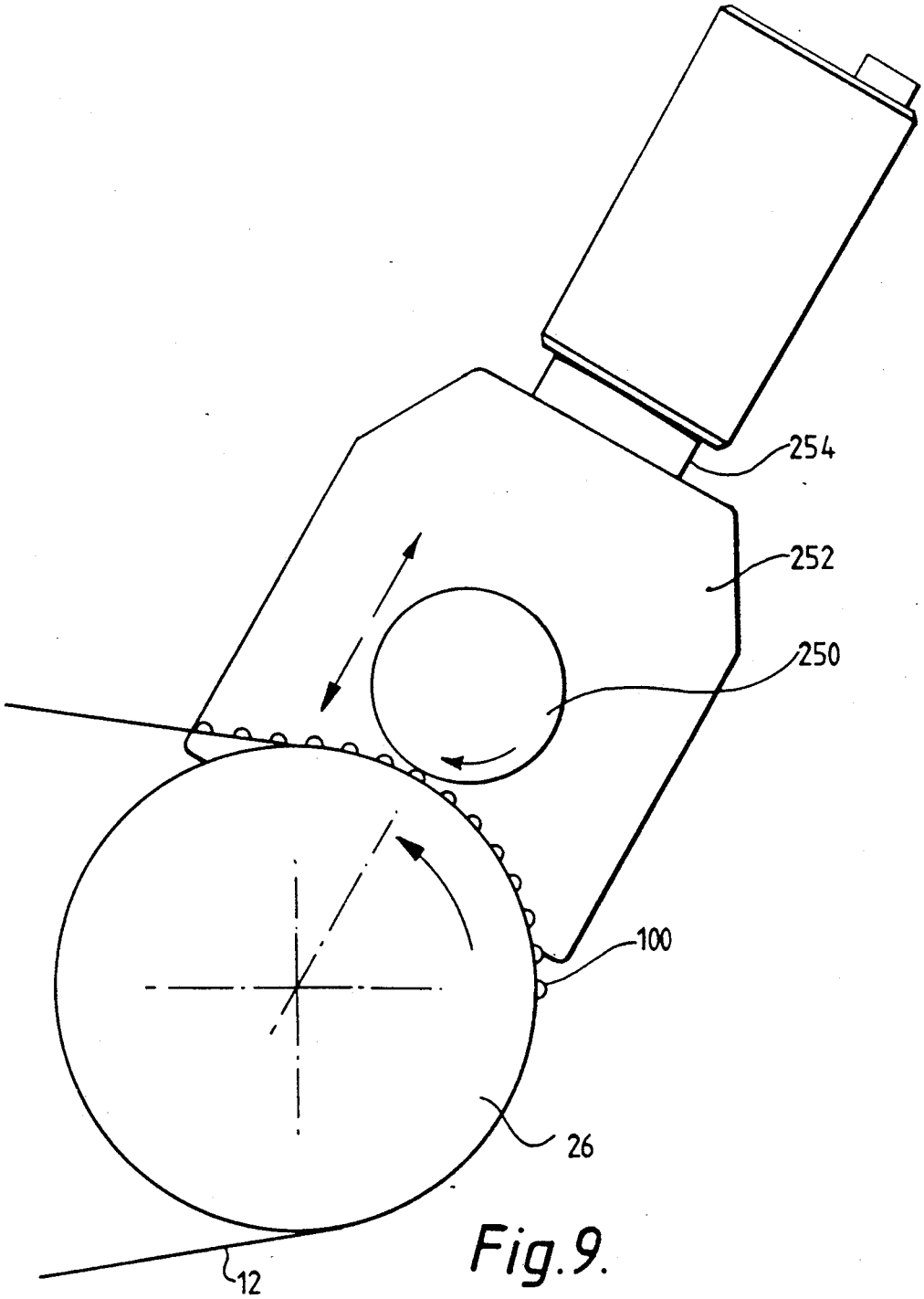
FIG. 9 shows, again on a larger scale an arrangement for controlling the fill weight of the blisters.

It is important to ensure that the weight of powder in each blister is the same to within fairly close tolerances, at least where the powder is a medicament or other substance where each blister must contain substantially the same predetermined dose. The way in which the blister packs are made in the present invention ensures that the volume of powder in each blister is substantially equal, but there can still be variations in weight as a result of variations in the bulk density of the powder. FIG. 9 shows a device for dealing with this problem. This comprises a roller 250 which is rotatably mounted on a head 252 and which can be moved radially with respect to the roller 26 around which the base sheet 12 with its blisters 100 travels before filling. The position of the roller is adjusted to vary the weight of powder which the blisters 100 can subsequently receive. If it is found that the weight of powder within each of the blisters has increased, as a result of an increase in the bulk density of the powder, the roller 250 is moved towards the axis of rotation of the roller 26 so that it comes into contact with the base of each blister as that blister passes it, thus making an indentation in the base of each blister. The greater the indentation which the roller makes, the smaller the resulting volume of the blisters, and hence the smaller the volume of powder which each blister can subsequently receive. The roller 250 is 22 undriven, and rotates purely as a result of contact with the blisters 100.

The roller 250 is fixedly mounted on the head 252, and both are movable together, with respect to the roller 26, by means of a motorised slide 254. Alternatively, the motorised slide can be omitted and the position of the head 252 adjusted by means of a manually operated micrometer screw.

As an alternative to the arrangement shown in FIG. 9, the blister-forming rollers 18 may be provided with means for varying the depth of the blisters.

FIGS. 10 and 10*a* show a modification which may be made to the slitting rollers 70 and 72. There is a tendency for the waste portions 84 cut from the edges thereof to continue to adhere to the lower slitting roller 72. Accordingly, to ensure that the waste material is stripped from this roller a foil separator 260 is positioned closely adjacent the surface of the roller 72. As can be see in FIG. 10*a*, the shape of this separator is profiled to conform to the surface of the roller 22 to ensure reliable stripping. As a precaution, a similar foil separator 262 may be positioned adjacent the roller 70, though the waste material is less likely to cling to the roller 70 than to the roller 72.

FIG. 11 shows a device which can be used in measuring the weight of powder in a blister in order to enable the weight of powder in the blisters to be adjusted, for example using the arrangement shown in FIG. 9. This comprises a powder accumulator 270 which has a chamber 272 therein. The chamber 272 communicates with one end of an inlet passage 274 the other end of which can be located over a powder-filled blister 100. The chamber 272 also communicates with one end of an outlet passage 276 the other end of which communicates, via a filter 278, with a source of vacuum. The filter 278 has a porosity such that air but not powder can pass through it.

The accumulator 270 is removably located in the apparatus of FIG. 1 or FIG. 7 at any convenient point between the filling station 30 and the rollers 58, 62, i.e. at a point where the blisters have been filled with powder but where the lid sheet has not yet been applied. The accumulator is then used to extract the contents of a predetermined number of blisters. The accumulator is then removed from the apparatus and weighed. The tare weight of the accumulator is already known, and thus the weighing operation gives the total weight of powder in the blisters from which it has been removed, and thus the average weight of powder in each of the blisters. This value is then compared with the desired weight and adjustments made appropriately. This sampling operation can be repeated as often as may be desired, in order to maintain the fill weight of the blisters substantially constant.

The results of the weighing operation can, if desired, be transmitted directly to such means as the apparatus may have for adjusting the fill weight, for example, the arrangement shown in FIG. 9, so as to cause the necessary adjustment to be made automatically.

Figure 6A:
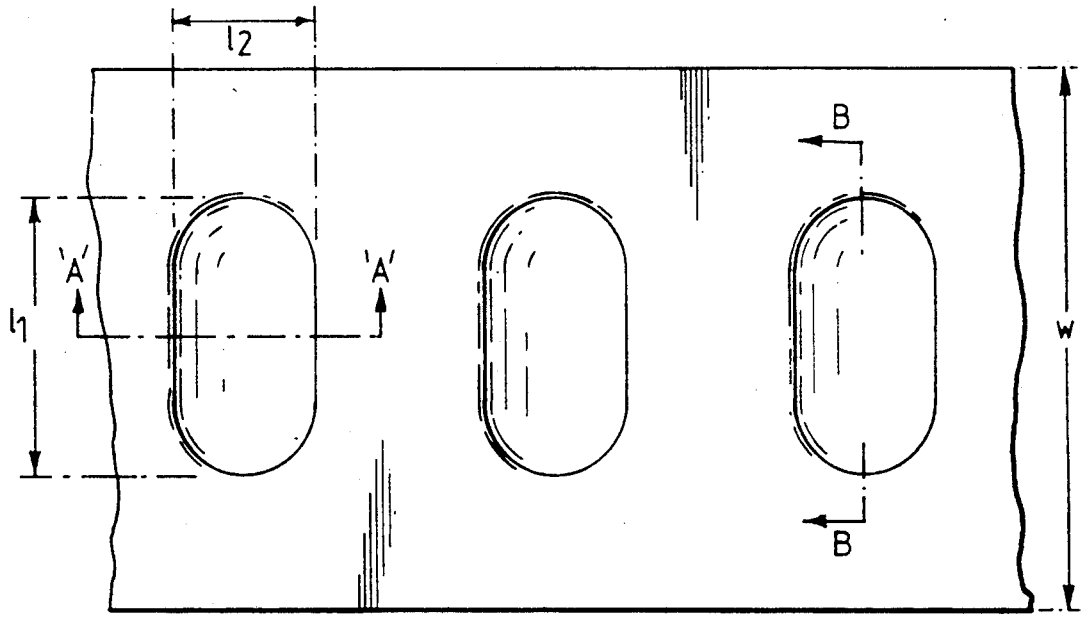
FIGS. 6*a*, 6*b* and 6*c* show an example of a base sheet of a blister pack, in plan view and in sections taken on line A—A and B—B, respectively.
Figure 6C:
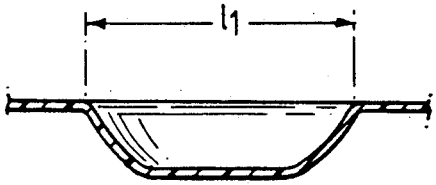
Figure 6B:
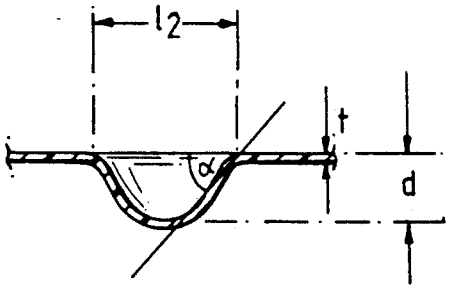

An example of a blister pack produced by the present invention is shown in FIG. 6*a* to 6*c*. Each blister has a length $l_1$ which is preferably from 1.5 to 15.0 mm, more preferably from 1.5 to 8.0 mm, and in an actual embodiment is equal to 6.4 mm, measured along its longer axis, and a length $l_1 = 3.4$ mm which is preferably from 1.5 to 10.0 mm, more preferably from 1.5 to 8.0 mm, and in an actual embodiment is equal to 3.4 mm, measured along its shorter axis. The blisters have bottoms which are rounded rather than flat, and have a depth d which is preferably from 0.5 to 4.5 mm, more preferably from 0.5 to 2.0 mm, and in an actual embodiment is equal to 1.5 mm. In the illustrated example the pack has a width w of 12.5 mm, having been cut from base and lid sheets both 25 mm wide, the thickness t of the base sheet is 0.18 mm, the combined thickness of the base and lid sheets is 0.27 mm, the blisters are at 7.5 mm centres along the blister pack, and each blister contains 12.5 mg of powder. Preferably, the powder is an inhalable medicament, with the active ingredient being mixed with a carrier which is preferably lactose.

As can be seen in FIGS. 6*b* and 6*c*, the blisters have sides which slope quite gently and they are quite shallow having regard to their dimensions as viewed in plan. These characteristics are a consequence of the fact that the blisters are produced by a cold forming process. The angle $\alpha$ is preferably from 40° to 60°, more preferably from 40° to 50°. Deeper blisters, with steeper sides, could be produced by techniques using heat, but that would not allow the use of aluminium foil cold-formable laminates, which have an excellent moisture barrier and which are thus highly suitable for pharmaceutical applications where the pharmaceutical materials are often sensitive to moisture.

Figure 4:
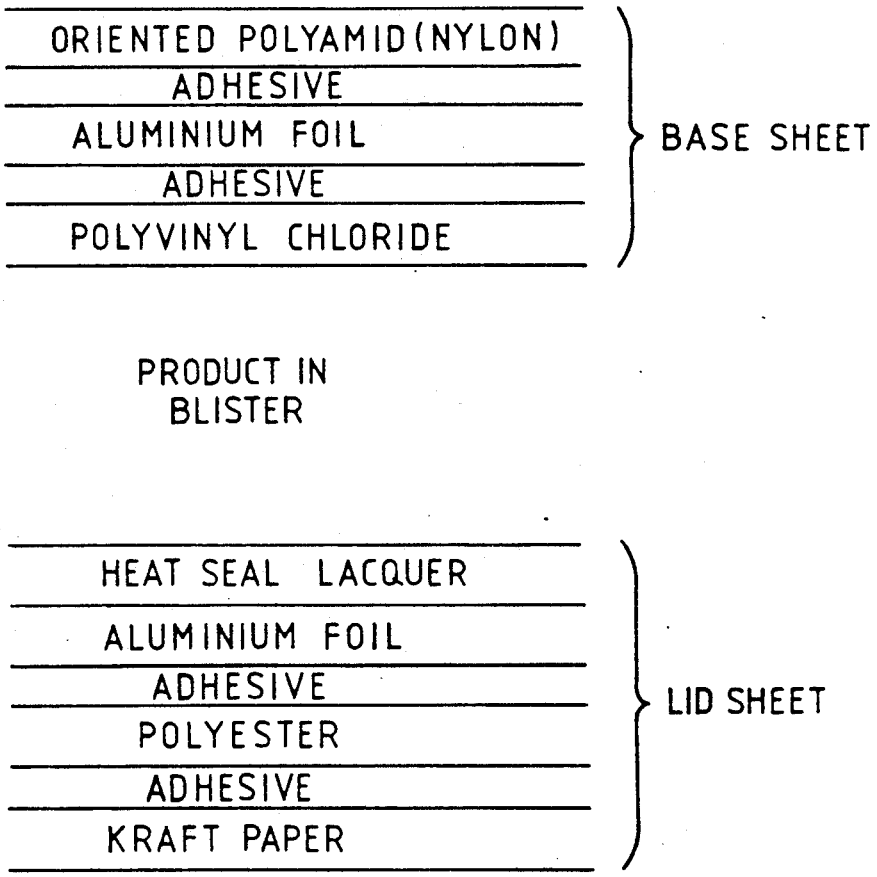
FIG. 4 shows diagrammatically the composition of materials which may be used in making the blister pack.

Any suitable materials can be used for the base and lid sheets, though if heat sealing is to be used then the materials must naturally be capable of being heat sealed. FIG. 4 shows diagrammatically one example of a combination of materials which can be used. It should be understood that this diagram is not to scale. Thus, the base sheet comprises, successively, layers of oriented polyamide (nylon), adhesive, aluminium foil, adhesive and polyvinyl chloride, and the lid sheet comprises successively layers of kraft paper, adhesive, polyester, adhesive, aluminium foil and heat seal lacquer, with the polyvinyl chloride of the base sheet being sealed to the heat seal lacquer of lid sheet except at the blisters themselves.

We claim:

1. A method of filling a blind cavity with a quantity of powder, which comprises urging the cavity, with its open side facing at least partially downwards, into a reservoir of powder, withdrawing therefrom the cavity having the quantity of powder therein while the open side continues to face at least partially downwards, and subsequently applying a lid to cover the cavity having the powder therein.

2. A method according to claim 1, wherein a blister is formed in a base sheet to provide said cavity, and a lid sheet, to provide said lid, is secured to the base sheet.

3. A method according to claim 1, wherein the lid and base sheets are elongate, and the base sheet has a plurality of blisters disposed along the length thereof.

4. A method according to claim 3, wherein the base sheet with the blisters formed therein passes around, and travels with, a wheel partially immersed in the said reservoir of powder.

5. A method according to claim 3, wherein the surface of the base sheet on which the blisters are open is cleaned before the lid sheet is secured thereto.

6. A method according to claim 3, wherein the surface of the base sheet is protected from the powder by a protecting member which is removed after the blisters have been filled and before the lid sheet is secured to the base sheet.

7. A method according to claim 3, wherein the base and lid sheets are wider than the blister pack desired to be produced therefrom, and the excess material is severed therefrom after the sheets have been secured together.

8. A method according to claim 3, wherein the blisters are formed in the base sheet by a rotary forming tool.

9. A method according to claim 2, wherein each blister has a side wall which extends at an angle of from 40°-60° to the plane of the base sheet.

10. A method of filling blind cavities with a quantity of powder, said method comprising urging the cavity with its open side facing at least partially downwards, into a reservoir of powder, withdrawing therefrom the cavities having the quantity of powder therein, and applying an elongate lid sheet to said base sheet to cover the cavities having the powder therein, wherein the cavities are provided by a plurality of blisters formed in an elongate base sheet and disposed along the length thereof, wherein the base sheet with blisters formed therein passes around, and travels with, a wheel partially immersed in the reservoir of powder and wherein the reservoir is rotatable about a vertical axis, and the wheel is rotatable about a horizontal axis at a velocity which at its circumference, is substantially the same as the velocity of the powder in the reservoir in the region where immersion occurs.

11. A method of filling blind cavities with a quantity of powder, said method comprising urging the cavity with its open side facing at least partially downwards, into a reservoir of powder, withdrawing therefrom the cavities having the quantity of powder therein, and applying an elongate lid sheet to said base sheet to cover the cavities having the powder therein, wherein the cavities are provided by a plurality of blisters formed in an elongate base sheet and disposed along the length thereof, wherein the volume of the blisters is altered after they have been formed of powder in blisters already filled deviates significantly from a desired value.

12. An apparatus for filling a blind cavity with a quantity of powder, which comprises a reservoir for containing powder, means for urging the cavity, with its open side facing at least partially downwards, into the reservoir of powder and for withdrawing therefrom the cavity having the quantity of powder therein while the open side continues to face at least partially downwards, and means for applying a lid to cover the cavity having the powder therein.

13. An apparatus according to claim 12, wherein the cavity is a blister formed in a base sheet and the lid is a lid sheet, the apparatus comprising a filling station at which the base sheet with the blister is urged into the reservoir, and a sealing station at which the base and lid sheets are secured to one another.

14. An apparatus according to claim 13, adapted to handle elongate lid and base sheets, the base sheet having a plurality of blisters defined along the length thereof.

15. An apparatus according to claim 14, wherein a wheel is provided at the filling station, the base sheet with the blisters formed therein passing around and travelling with, the wheel, the wheel being partially immersed in the reservoir of powder.

16. An apparatus according to claim 14, comprising means for cleaning the surface of the base sheet on which the blisters are open, before the lid sheet is secured thereto.

17. An apparatus according to claim 14, wherein the base and lid sheets are wider than the blister pack desired to be produced therefrom, and trimming means are provided for severing the excess material therefrom after the sheets have been secured together.

18. An apparatus according to claim 17, wherein the trimming means comprise a pair of trimming rollers between which the lid and base sheets pass, the trimming means further comprising at least one separator member for preventing the excess material adhering to the trimming rollers.

19. An apparatus according to claim 17, wherein the trimming means comprises two crimping means, one positioned at either side of the sealed assembly of lid and base sheets to crimp, and thereby grip, the edge portions of the assembly, the crimping means each being provided with a severing device to sever the crimped material.

20. An apparatus according to claim 14, which comprises means for altering the path length of the base sheet upstream of the sealing station, to maintain registration between the blisters on the base sheet and cooperating means at the sealing station.

21. An apparatus according to claim 14, comprising blister-forming means for forming the blisters in the base sheet.

22. An apparatus according to claim 21, wherein the blister-forming means are rotary means.

23. An apparatus according to claim 21, wherein the blister-forming means are adapted to form blisters with a side wall which extends at an angle of from 40°-60° to the plane of the base sheet.

24. An apparatus for filling blind cavities with a quantity of powder, wherein the cavities are provided by a plurality of blisters formed in an elongate base sheet and disposed along the length thereof, said apparatus comprising a reservoir for containing powder; a filling station at which the base sheet with the blisters is urged into the reservoir; a wheel at the filling station, the wheel being partially immersed in the reservoir of powder; means for urging the cavity, with its open side facing at least partially downwards into the reservoir of powder and for withdrawing therefrom the cavities having the quantity of powder therein; and a sealing station means for applying and securing an elongate lid sheet to the base sheet to cover the cavities having the powder therein; wherein the base sheet with the blisters formed therein passes around and travels with the wheel, wherein said reservoir is rotatable about a vertical axis; and wherein said wheel is rotatable about a horizontal axis at a velocity which, at its circumference, is substantially the same as the velocity of the powder in the reservoir where immersion occurs.

25. An apparatus for filling blind cavities with a quantity of powder, wherein the cavities are provided by a plurality of blisters formed in an elongate base sheet and disposed along the length thereof, said apparatus comprising a reservoir for containing powder; a filling station at which the base sheet with the blisters is urged into the reservoir; means for urging the cavity with its open side facing at least partially downwards into the reservoir of powder and for withdrawing therefrom the cavity having the quantity of powder therein; a sealing station means for applying and securing the elongate lid sheet to the base sheet to cover the cavities having the powder therein; and means for cleaning the surface of the base sheet in which the blisters are open, before the lid sheet is secured thereto, wherein the cleaning means comprises a cleaning member rotatable about an axis perpendicular to the plane of the base sheet the cleaning member carrying a plurality of teeth each having a radial width substantially equal to the gap between adjacent blisters, rotation of the cleaning member being synchronized with movement of the base sheet so that successive teeth wipe successive ones of the gaps as the base sheet passes through the cleaning station.

26. An apparatus according to claim 25, further comprising at least one doctor blade for wiping all or part of the said surface of the bas sheet.

27. An apparatus for filling blind cavities with a quantity of powder, wherein the cavities are provided by a plurality of blisters formed in an elongate base sheet and disposed along the length thereof, said apparatus comprising a reservoir for containing powder; a filling station at which the base sheet with the blisters is urged into the reservoir; means for urging the cavity with its open side facing at least partially downward into the reservoir of powder and for withdrawing therefrom the cavity having the quantity of powder therein; a sealing portion means for applying and securing an elongate lid to the base sheet to cover the cavities having the powder therein; means for applying a protecting member to the surface of the base sheet on which the blisters are open, except at the surface of the blisters themselves, and means for removing the protecting member after the blisters have been filled and before the lid is secured to the base sheet.

28. An apparatus according to claim 27, wherein the protecting member is an elongated sheet having apertures therein which register respectively with the blisters.

29. An apparatus according to claim 28, wherein the elongate sheet comprises a removable backing member, and means are provided for removing the backing member prior to the remainder of the elongate sheet assuming a position in which its apertures register with the blisters.

30. An apparatus for filling blind cavities with a quantity of powder, wherein the cavities are provided by a plurality of blisters formed in an elongate base sheet and disposed along the length thereof, said apparatus comprising a reservoir for containing powder; a filling station at which the base sheet with the blisters is urged into the reservoir; means for urging the cavity with its open side facing at least partially downwards into the reservoir of powder and for withdrawing therefrom the cavity having the quantity of powder therein; and a sealing station means for applying and securing an elongate lid to the base sheet to cover the cavities having the powder therein; wherein the sealing station means for applying the lid sheet comprises a pair of sealing rollers mounted in cantilever fashion, at least one of the rollers being mounted on a self-aligning bearing to maintain the surfaces of the rollers substantially parallel to one another.

31. An apparatus for filling blind cavities with a quantity of powder, wherein the cavities are provided by a plurality of blisters formed in an elongate base sheet and disposed along the length thereof, said apparatus comprising a reservoir for containing powder; a filling station at which the base sheet with the blisters is urged into the reservoir; means for urging the cavity with its open side facing at least partially downward into the reservoir of powder and for withdrawing therefrom the cavity having the quantity of powder therein; a sealing station means for applying an securing an elongate lid to the base sheet to cover the cavities having the powder therein; and means for measuring the weight of powder from a predetermined number of blisters, before the lid is secured to the base sheet.

32. An apparatus according to claim 31, wherein the measuring means comprises means for transporting the powder from a predetermined number of blisters, before the lid sheet is secured to the base sheet, to a weighing container.

33. An apparatus according to claim 32, wherein the weighing container is removably mounted in the apparatus and is adapted to be received in an external weighing device.

34. An apparatus according to claim 33, wherein the external weighing device is connected to supply a signal to vary the filling conditions in such a sense as to maintain a substantially constant weight of powder in the blisters.

35. An apparatus according to claim 31 comprising means for altering the volume of the blisters after they have been formed but before they are filled, if the said measuring means detects that the said weight deviates significantly from a desired value.

36. An apparatus according to claim 35, wherein the said means for altering the volume comprises a member which is adapted to be brought into contact to a variable extent with the external surface of the blisters to produce indentations therein and thereby reduce their volume.

* * * * *

UNITED STATES PATENT AND TRADEMARK OFFICE

CERTIFICATE OF CORRECTION

PATENT NO. : 5,187,921
DATED : February 23, 1993
INVENTOR(S) : Alan A. Wilson, Peter J. Brand, David R. Judd and Stanley G. Bonney It is certified that error appears in the above-identified patent and that said Letters Patent is hereby corrected as shown below:

Claim 3,
Line 1, change "1" to -- 2 --.

Signed and Sealed this

Sixteenth Day of April, 2002

*Attest:*

*Attesting Officer*

JAMES E. ROGAN
*Director of the United States Patent and Trademark Office*